US006940057B2

(12) United States Patent
Kim

(10) Patent No.: US 6,940,057 B2
(45) Date of Patent: Sep. 6, 2005

(54) MICROWAVE OVEN

(75) Inventor: Kyoung Ho Kim, Suwon-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/838,202

(22) Filed: May 5, 2004

(65) Prior Publication Data

US 2005/0067412 A1 Mar. 31, 2005

(30) Foreign Application Priority Data

Sep. 29, 2003 (KR) ..... 10-2003-0067541

(51) Int. Cl.[7] ..... H05B 6/76
(52) U.S. Cl. ..... 219/743; 219/741; 174/35 GC
(58) Field of Search ..... 219/739–744; 174/35 MS, 35 GC

(56) References Cited

U.S. PATENT DOCUMENTS

| | | | | |
|---|---|---|---|---|
| 4,559,428 A | * | 12/1985 | Takeuji | 219/743 |
| 5,075,525 A | | 12/1991 | Jung | |
| 5,750,969 A | | 5/1998 | Lee | |
| 5,942,144 A | * | 8/1999 | Lee | 219/738 |

FOREIGN PATENT DOCUMENTS

| | | | | |
|---|---|---|---|---|
| JP | 05026459 A | * | 2/1993 | 219/743 |
| JP | 10-241855 | | 9/1998 | |
| KR | 10-148906 | | 6/1998 | |
| KR | 10-202550 | | 3/1999 | |

OTHER PUBLICATIONS

English translation of JP 05–026459 (HORI), Feb. 2, 1993 (previously cited).*

* cited by examiner

*Primary Examiner*—Philip H. Leung
(74) *Attorney, Agent, or Firm*—Staas & Halsey LLP

(57) ABSTRACT

A microwave oven including a cabinet defining a cooking chamber therein, and a door coupled to the cabinet to open and close the cooking chamber. The door includes a door frame forming an appearance of the door, a shielding plate installed in the door frame to prevent high-frequency electromagnetic waves from radiating from a small gap between the door and the cabinet, a choke member provided at a peripheral edge of the shielding plate and having a high-frequency choke groove, a cover to cover the high-frequency choke groove, and a retaining member provided at the cover to elastically support the choke member. When the cover is attached to the choke member, an end of the choke member is supported on an inner rib section of the cover via the retaining member, thus reducing deformation of the choke member.

18 Claims, 4 Drawing Sheets

MICROWAVE OVEN

CROSS-REFERENCE TO RELATED APPLICATIONS

This application claims the benefit of Korean Patent Application No. 2003-67541, filed Sep. 29, 2003 in the Korean Intellectual Property Office, the disclosure of which is incorporated herein by reference.

BACKGROUND OF THE INVENTION

1. Field of the Invention

The present invention relates to a microwave oven, and more particularly, to a microwave oven, which is designed to prevent a choke member of a door from being deformed during an assembly of the door.

2. Description of the Related Art

Generally, a microwave oven is a cooking appliance that is intended to cook foods in a cooking chamber by heat from intermolecular friction, which is generated by increasing the vibration of the water molecules of the foods with high-frequency electromagnetic wave energy introduced into the cooking chamber from a magnetron.

The microwave oven includes a cabinet, which is comparted into a cooking chamber and an electric component compartment. The electric component compartment contains a magnetron to generate high-frequency electromagnetic waves into the cooking chamber, and a high voltage transformer to apply a high voltage to the magnetron.

A door is rotatably coupled to a front face of the cabinet corresponding to a front face of the cooking chamber to open and close the cooking chamber. The door includes a door frame having a transparent surface at its center and defining an appearance of the door, and a screen-shaped shielding plate attached to an inner surface of the door frame to block high-frequency electromagnetic waves. The shielding plate is bent inwardly at the edges thereof to form a choke member having a high-frequency choke groove. The choke member is configured such that the high-frequency choke groove is opened over a predetermined length to face the front face of the cabinet.

The high-frequency choke groove is covered with a cover, which is disposed between a rear face of the shielding plate and the font face of the cabinet, so as to prevent ingression of extraneous substances into the high-frequency choke groove. The cover includes an inner rib section extending into the high-frequency choke groove through an opening of the high-frequency choke groove, an outer rib section extending between the door frame and the choke member, and a connecting section connected between the inner end section and the outer end section.

In the conventional microwave oven, because the inner rib section of the cover, which extends into the high-frequency choke groove, is maintained to be spaced apart from the end of the choke member without a separate support, the end of the choke member may be deformed toward the inner rib section of the cover when an excessive force impacts the door during an assembly of the door. The deformation of the choke member causes high-frequency electromagnetic waves to radiate from the small gap between the door and the cabinet.

SUMMARY OF THE INVENTION

It is an aspect of the present invention to provide a microwave oven, which is improved in a structure of a door thereof, to prevent deformation of a choke member, which may occur during an assembly of the door.

Additional aspects and/or advantages of the invention will be set forth in part in the description which follows and, in part, will be obvious from the description, or may be learned by practice of the invention.

The above and/or other aspects are achieved by providing a microwave oven including a cabinet defining a cooking chamber therein, and a door coupled to the cabinet to open and close the cooking chamber. The door includes a door frame forming an appearance of the door, a shielding plate installed in the door frame to prevent high-frequency electromagnetic waves from radiating from the small gap between the door and the cabinet, a choke member provided at a peripheral edge of the shielding plate and having a high-frequency choke groove, a cover to cover the high-frequency choke groove, and a retaining member provided at the cover to elastically support the choke member.

The cover may include an inner rib section extended into the high-frequency groove, and an outer rib section extended between the door frame and the choke member, and the retaining member may be disposed between an end of the choke member near to an opening of the high-frequency choke groove and the inner rib section of the cover.

The retaining member may be provided along the inner rib section of the cover.

The end of the choke member may be extended into the high-frequency choke groove, and the retaining member may include an extension section, which is extended toward the end of the choke member from the inner rib section of the cover, and a support section extended from an end of the extension section while being parallel to the end of the extension section, to support the end of the choke member.

The retaining member may further include an inclined section extended from an end of the support section while being inclined toward the inner rib section of the cover, to guide the retaining member into the high-frequency choke groove, in which an end of the inclined section is spaced apart from the inner rib section of the cover by a predetermined distance.

The retaining member may further include a contact section provided at an end of the inclined section, which comes into contact with the inner rib section of the cover when the retaining member is elastically deformed, so as to allow the retaining member to be deformed within a certain deformation range.

BRIEF DESCRIPTION OF THE DRAWINGS

These and/or other aspects and advantages of the invention will become apparent and more readily appreciated from the following description of the embodiments taken in conjunction with the accompanying drawings in which.

DETAILED DESCRIPTION OF THE PREFERRED EMBODIMENTS

Figure 1:
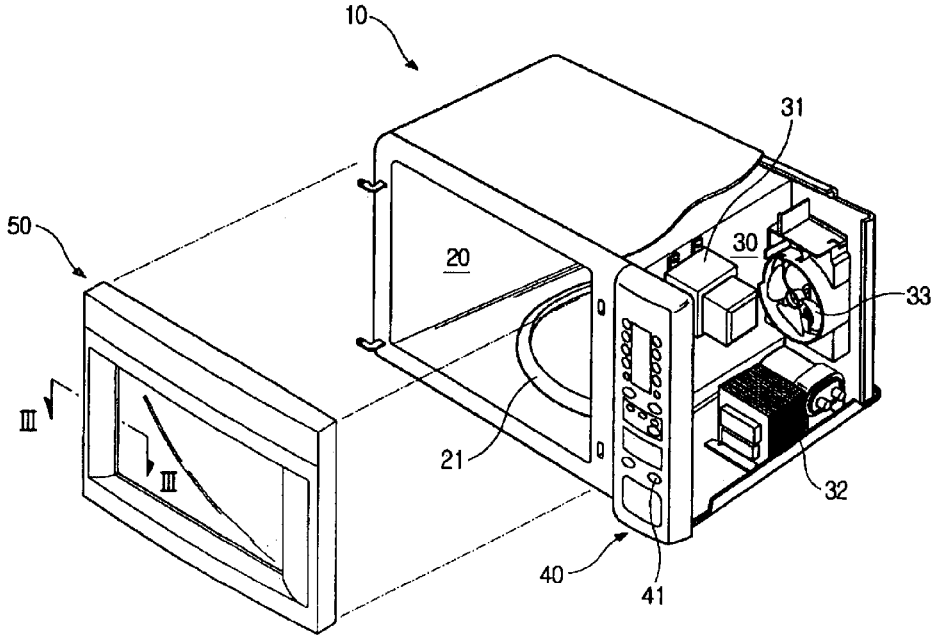
FIG. 1 is a perspective view of a microwave oven according to an embodiment of the present invention, in which a door is removed from a cabinet.

Reference will now be made in detail to the embodiments of the present invention, examples of which are illustrated in the accompanying drawings, wherein like reference numerals refer to like elements throughout. The embodiments are described below to explain the present invention by referring to the figures.

As shown in FIG. 1, a microwave oven according to an embodiment of the present invention includes a cabinet 10, which is comparted into a cooking chamber 20 and an electric component compartment 30 containing various electric components.

The cooking chamber 20 includes a cooking tray 21 rotatable by a motor (not shown). The electric compartment 30 includes a magnetron 31 to irradiate high-frequency electromagnetic waves into the cooking chamber 20, a high voltage transformer 32 to apply a high voltage to the magnetron 31, and a cooling fan 33 to cool the various electric components housed in the electric component compartment 30.

A control panel 40, which has a plurality of control buttons 41 to control various functions of the microwave oven, is coupled to a front face of the electric component compartment 30 of the cabinet 10. A door 50 is hingedly coupled to a front face of the cooking chamber 20 of the cabinet 10, to open and close the cooking chamber 20.

In the microwave oven according to this embodiment of the present invention, food to be cooked is placed on the cooking tray 21 and the door 50 is closed. Thereafter, when the control panel 40 is manipulated by a user, high-frequency electromagnetic waves generated from the magnetron 31 are introduced into the cooking chamber 20 to cook the food in a cooking chamber by heat from intermolecular friction, which is generated by increasing the vibration of the water molecules of the food.

Figure 2:
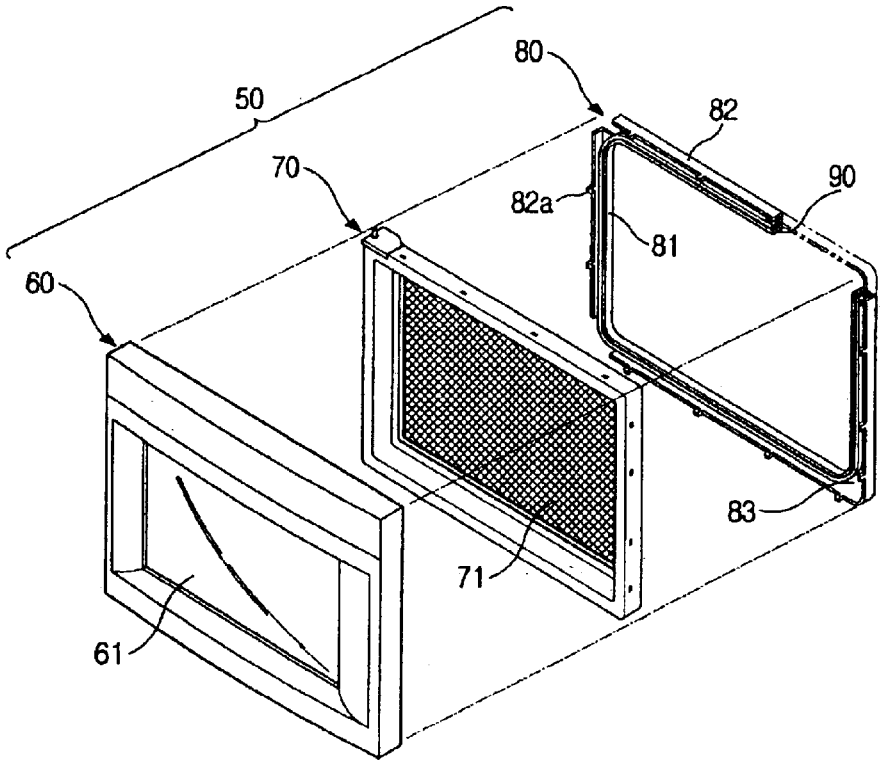
FIG. 2 is an exploded perspective view of the door of the microwave oven of FIG. 1.
Figure 3:
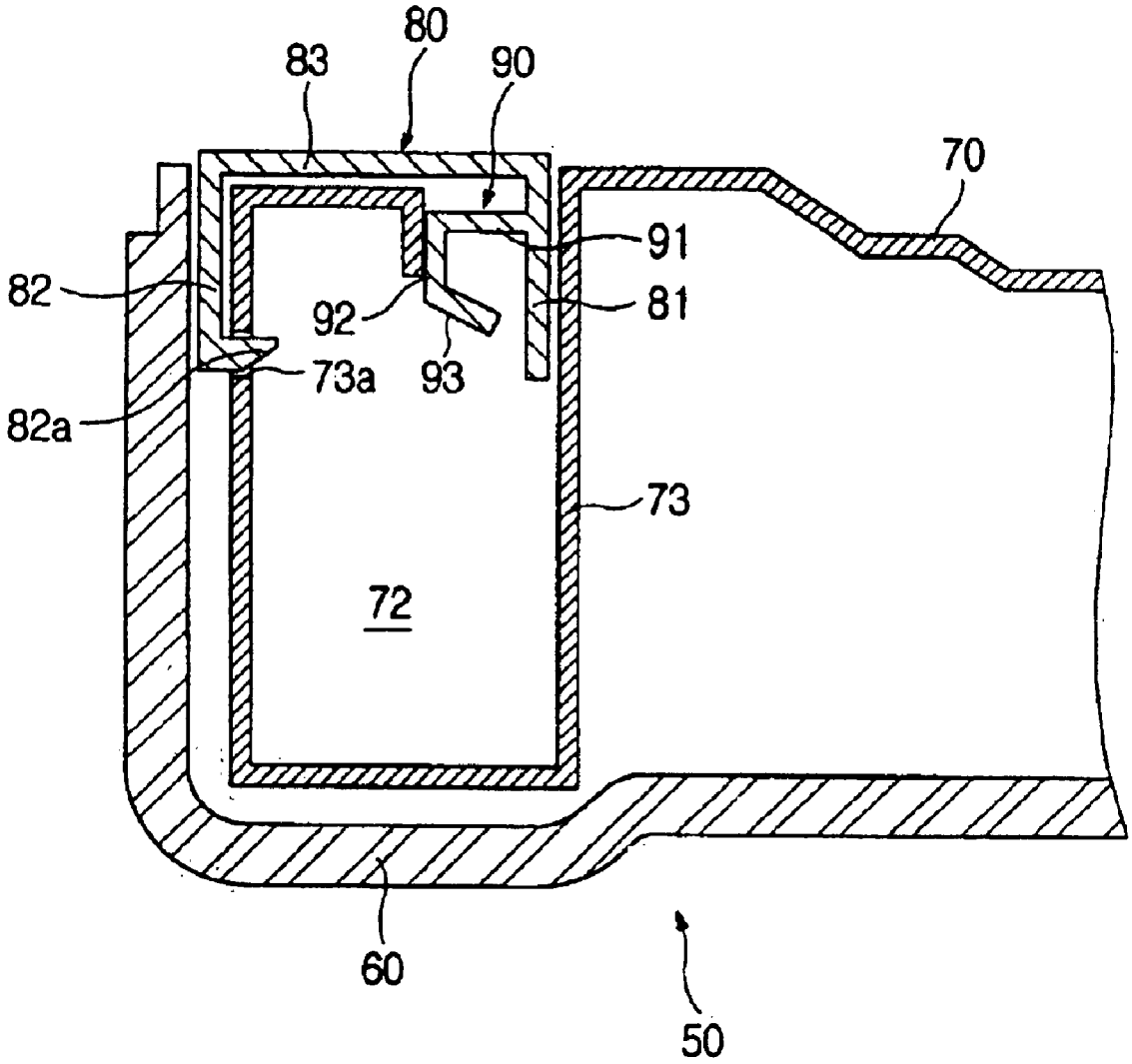
FIG. 3 is a cross-sectional view taken along line III—III of FIG. 1.

As shown in FIGS. 2 and 3, the door 50 includes a box-shaped door frame 60 defining an appearance of the microwave oven and opening at its rear face, and a shielding plate 70 fitted in the door frame 60 to block high-frequency electromagnetic waves.

The door frame 60 includes a transparent window 61 at the center thereof to allow a user to view inside the cooking chamber 20. The shielding plate 70 includes a screen member 71 at the center thereof, to allow a user to view the inside of the cooking chamber 20, similar to the transparent window 61. The shielding plate 70 is bent inwardly at an edge thereof to form a choke member 73 having a high-frequency choke groove 72.

The choke member 73 is provided to prevent high-frequency electromagnetic waves from radiating from the small gap between the door 50 and the cabinet 10. The choke member 73 is formed along a peripheral edge of the shielding plate 70, and opened toward the front face of the cabinet 10 at a predetermined area thereof.

The door 50 includes a cover 80 to cover the high-frequency choke grooves 72 in a state of the shielding plate 70 being fitted in the door frame 60. The cover 80 includes an inner rib section 81 extending into the high-frequency choke groove 72 through an opening of the choke groove 72, and an outer rib section 82 extending between the door frame 60 and the choke member 73, and a connecting section 83 connecting the inner and outer rib sections 81 and 82 to each other, to prevent ingression of extraneous substances into the high-frequency choke groove 72. The outer rib section 82 of the cover 80 includes hooks 82*a* at an end thereof, so as to hold the cover 80 in the shielding plate 70. The choke member 73 includes hook holes 73*a*, into which the hooks 82*a* are fitted.

In an assembly of the door 50, the shielding plate 70 is fitted into the door frame 60, and the high-frequency choke groove 72 is covered with the cover 80. Thereafter, when the cover 80 is forcedly pressed toward the door frame 60, the components of the door 50 come into close contact with each other, thus completing the assembly of the door 50.

The cover 80 includes a retaining member 90 to prevent deformation of the choke member 73 during assembly of the door 50.

The retaining member 90 is provided between the opening of the high-frequency choke groove 72, that is an end of the choke member 73 and the inner rib section 81 of the cover 80. Because an external force is applied to the choke member 73 when the hooks 82*a* are fitted into the hook holes 73*a*, the choke member 73 may be deformed. The retaining member 90 is intended to prevent the deformation of the choke member 73.

In this embodiment, the retaining member 90 is integrally formed with the cover 80, and protruded along the inner rib section 81 of the cover. Since the retaining member 90 is positioned between the opening of the high-frequency choke groove 72, that is the end of the choke member 73 and the inner rib section 81 of the cover, the choke member 73 is supported on the inner rib section 81 of the cover 80 during an assembly of the door 50, thus preventing deformation of the choke member 73.

The retaining member 90 is elastically deformable to elastically support the end of the choke member 73, so that the cover 73 is easily fitted into the choke member 73 at the time of fitting of the cover 73. To this end, the retaining member 90 includes an extension section 91 extended toward the end of the choke member 73, and a support section 92 extended from an end of the extension section 91 while being substantially parallel to the end of the choke member 73, to support the end of the choke member 73. Since the end of support section 92 is a free end, which is elastically deformable, the support section 92 can elastically support the end of the choke member 73 while being in contact with the end of the choke member 73.

The retaining member 90 further includes an inclined section 93, which is extended from an end of the support section 92 while being inclined toward the inner rib section 81 of the cover 80. When the retaining member 90 is inserted into the high-frequency choke groove 72, the inclined section 93 is moved along the end of the choke member 73, thereby allowing the cover 80 to be easily fitted into the choke member 73. An end of the inclined section 93 is spaced apart from the inner rib section 81 of the cover 80, so that the support section 92 is elastically deformed within the spaced distance.

Figure 4:
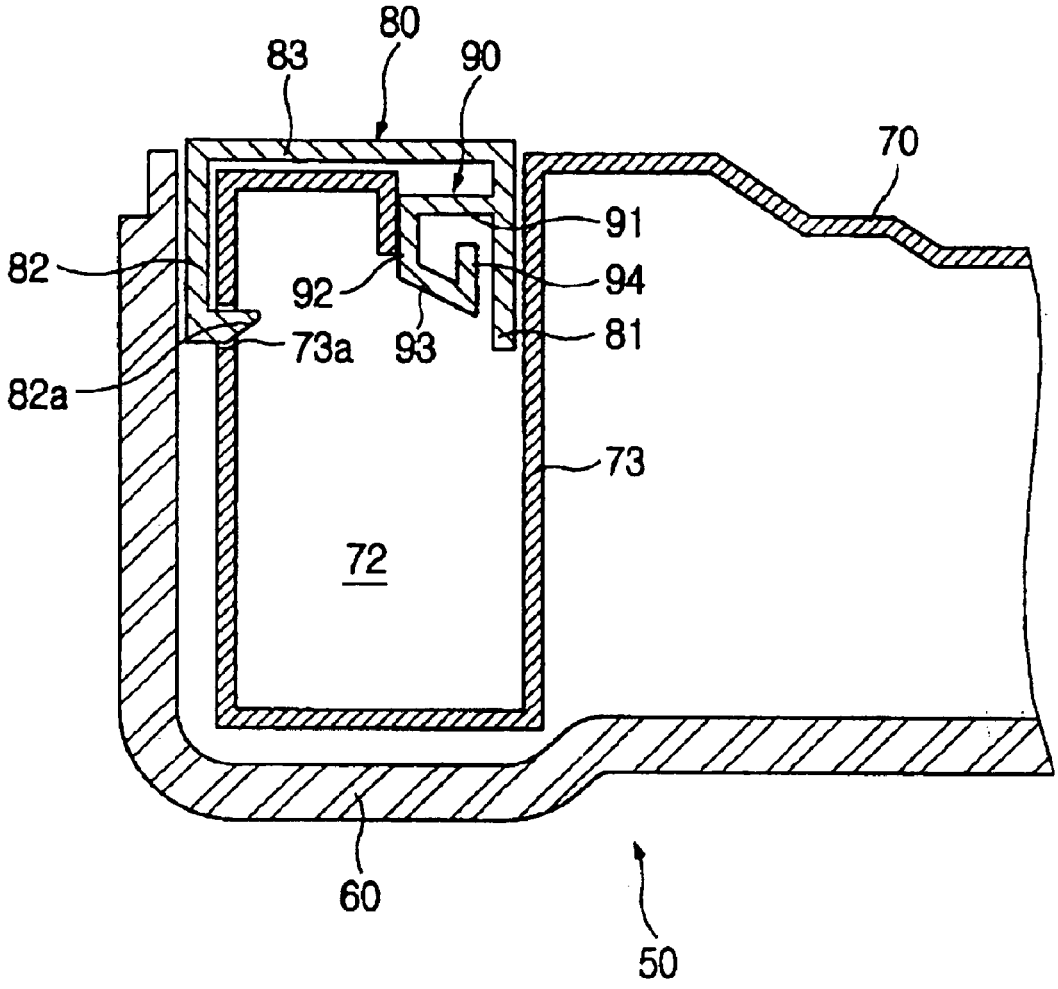
FIG. 4 is a cross-sectional view of a microwave oven according to another embodiment of the present invention, which is taken along line III—III of FIG. 1.

As shown in FIG. 4, the retaining member 90 may include a contact section 94. As the support section 92 is elastically deformed, the contact section 94 comes into frictional contact with the inner rib section 81 of the cover 80. Accordingly, the support section 92 is deformed within a certain deformation range, thereby preventing the support section 92 from being plastically deformed.

An assembly process and functions of the door of the microwave oven according to the present invention will now be described.

First, by inserting the hooks 82*a* of the cover 80 into the hook holes 73*a* of the shielding plate 70, the cover 80 is joined to the shielding plate 70, thereby covering the high-frequency choke groove 72. When the cover 80 is joined to the shielding plate 70, the cover 80 is guided into the high-frequency choke groove 72 by the inclined section of the retaining member 90. After the retaining member 90 is inserted into the high-frequency choke groove 72 while being elastically deformed, the retaining member 90 is restored to its normal position. As a result, the retaining member 90 is disposed between the inner rib section 81 of the cover 80 and the end of the choke member 73, thus supporting the inner rib section 81 of the cover 80 and the end of the choke member 73.

When the cover 80 is fitted into the choke member 73, a force, which is directed toward the inner rib section 81 of the cover 80, is applied to the choke member 73 by the hooks 82*a*. At this point, because the end of the choke member 73 is supported on the inner rib section 81 of the cover 80 via the retaining member 90, an inward deformation of the choke member 73 is reduced. Even though the choke member 73 is slightly deformed, the retaining member 90 is elastically restored to its normal position, thus greatly reducing deformation of the choke member 73.

As is apparent from the above description, the present invention provides a microwave oven, which includes a retaining member provided on an inner rib section of a cover to support an end of a choke member. Accordingly, when the cover is installed with the choke member, the end of the choke member is supported on the inner rib section of the cover via the retaining member, thereby reducing deformation of the choke member.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A microwave oven comprising:

a cabinet defining a cooking chamber therein; and a door coupled to the cabinet to open and close the cooking chamber, the door comprising:

a door frame to form an appearance of the door, a shielding plate installed in the door frame to prevent high-frequency electromagnetic waves from radiating from a small gap between the door and the cabinet, a choke member provided at a peripheral edge of the shielding plate and having a high-frequency choke groove, a cover to cover the high-frequency choke groove, and a retaining member provided at the cover to elastically support the choke member, wherein the cover includes an inner rib section extended into the high-frequency groove and an outer rib section extended between the door frame and the choke member, and the retaining member is disposed between an end of the choke member near an opening of the high-frequency choke groove and the inner rib section of the cover.

2. The microwave oven as set forth in claim 1, wherein the retaining member is provided along the inner rib section of the cover.

3. The microwave oven as set forth in claim 1, wherein the end of the choke member is extended into the high-frequency choke groove, and the retaining member includes an extension section that is extended toward the end of the choke member from the inner rib section of the cover and a support section that is extended from an end of the extension section while being parallel to the end of the extension section, to support the end of the choke member.

4. The microwave oven as set forth in claim 3, wherein the retaining member further includes an inclined section extended from an end of the support section while being inclined toward the inner rib section of the cover, to guide the retaining member into the high-frequency choke groove, wherein an end of the inclined section is spaced apart from the inner rib section of the cover by a predetermined distance.

5. The microwave oven as set forth in claim 4, wherein the retaining member further includes a contact section provided at an end of the inclined section, which comes into contact with the inner rib section of the cover when the retaining member is elastically deformed, to allow the retaining member to be deformed within a certain deformation range.

6. A door having a door frame attached thereto that is hingedly attached to a chamber to provide an access to a cavity and to confine a source of energy to within the cavity, wherein the door comprises:

a shielding plate attached to an inner surface of the door frame to prevent the energy from emitting outside of the door, wherein the shielding plate is inwardly bent at the edges thereof to form a choke member having a high-frequency choke groove to cancel out energy emissions; and a cover that is attached to an inner surface of the door frame and located between the shielding plate and the front of the cavity to prevent a substance from entering into the high-frequency choke groove; wherein the cover includes:

a retaining member to reduce deformation of the choke member when an external force is applied to the choke member, wherein the cover further includes an inner rib section extending into the high-frequency choke groove, an outer rib section extending between the door frame and the choke member, and a connecting section to connect the inner rib section and the outer rib section to each other to prevent a substance from entering into the high-frequency choke groove.

7. The door as claimed in claim 6, wherein the cover includes at least one hook and the choke member includes at least one hook hole into which the at least one hook is attached in order to hold the cover in the shielding plate, thereby covering the high-frequency groove.

8. The door as claimed in claim 6, wherein the retaining member is integrally formed with the cover.

9. The door as claimed in claim 6, wherein the retaining member is an elastically deformable material in order to allow for the cover to be fitted into the choke member.

10. The door as claimed in claim 8, wherein the retaining member is in an elastically deformed position when the retaining member is inserted into the high-frequency choke groove, and the retaining member is restored to an original position after the retaining member is inserted into the high-frequency choke groove.

11. The door as claimed in claim 9, wherein the retaining member is located between an inner rib section of the cover and an end of the choke member in order to support the inner rib section of the cover and the end of the choke member.

12. The door as claimed in claim 11, wherein the retaining member provides support to the end of the choke member while in contact with the end of the choke member, thereby reducing deformation of the choke member.

13. The door as claimed in claim 12, wherein the retaining member includes an extension section to support the end of the choke member, wherein the extension section extends into a center area of the high-frequency groove toward the end of the choke member.

14. The door as claimed in claim 13, wherein the retaining member further includes a support section that is extended from an end of the extension section to support the end of the choke member, wherein the support section is substantially parallel to the end of the choke member.

15. The door as claimed in claim 14, wherein the retaining member further includes an inclined section that is extended from an end of the support section and forms an incline towards an inner side of the cover.

16. The door as claimed in claim 15, wherein the inclined section moves along the end of the choke member when the retaining member is inserted into the high-frequency choke groove in order to allow the cover to be fitted into the choke member.

17. The door as claimed in claim 15, wherein the retaining member further includes a contact section attached to the end of the inclined section to come into contact with the inner side of the cover when the retaining member is elastically deformed to prevent the retaining member from being plastically deformed.

18. A microwave oven door having a door frame attached thereto that is hingedly attached to a chamber to provide an access to the microwave oven, wherein the microwave oven door comprises:

a choke member having a high-frequency choke groove to cancel out energy emissions; and a cover that is attached to an inner surface of the door frame and includes a retaining member to prevent deformation of the choke member when an external force is applied to the choke member, wherein when the cover is installed with the choke member, an end of the choke member is supported on an inner rib section of the cover via the retaining member.

* * * * *